US007331843B2

(12) United States Patent
Kunitake et al.

(10) Patent No.: US 7,331,843 B2
(45) Date of Patent: Feb. 19, 2008

(54) SUBSTRATE POLISHING METHOD AND METHOD OF MANUFACTURING SEMICONDUCTOR DEVICE

(75) Inventors: Hideaki Kunitake, Toyama (JP); Mamoru Kanemoto, Toyama (JP); Katsuyuki Ikenouchi, Toyama (JP); Yasunori Fukui, Toyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/712,470

(22) Filed: Mar. 1, 2007

(65) Prior Publication Data

US 2007/0212882 A1 Sep. 13, 2007

(30) Foreign Application Priority Data

Mar. 7, 2006 (JP) ..... 2006-061601

(51) Int. Cl.
*B24B 49/00* (2006.01)

(52) U.S. Cl. ..... 451/5; 451/8; 451/28

(58) Field of Classification Search ..... 451/5, 451/8, 11, 28, 41; 438/691, 692; 216/89
See application file for complete search history.

(56) References Cited

U.S. PATENT DOCUMENTS 6,932,671 B1 * 8/2005 Korovin et al. ..... 451/5
7,070,477 B2 * 7/2006 Morisawa et al. ..... 451/5

FOREIGN PATENT DOCUMENTS

JP 2003-249467 9/2003

* cited by examiner

*Primary Examiner*—Dung Van Nguyen
(74) *Attorney, Agent, or Firm*—McDermott Will & Emery LLP

(57) ABSTRACT

The substrate polishing method of the present invention can be used, in a substrate polishing apparatus having multiple carriers for one polishing pad, for determining a polishing time necessary to obtain a specific amount of polishing in polishing substrates using only some of the carriers among multiple carriers. In the present method, a correction coefficient indicating the correlation between the polishing time in polishing substrates using all the carriers and the polishing time in polishing substrates using only a part of the carriers is obtained in advance. The polishing time necessary for the specific amount of polishing in polishing substrates using only a part of the carriers is calculated based on the correction coefficient and the polishing time necessary for polishing the specific amount of polishing in polishing substrates using all of the carriers. By this, the amount of polishing of a factional number of substrates can be easily made to coincide with the amount of polishing of other substrates polished using all of the carriers.

16 Claims, 5 Drawing Sheets

SUBSTRATE POLISHING METHOD AND METHOD OF MANUFACTURING SEMICONDUCTOR DEVICE

CROSS-REFERENCE TO RELATED APPLICATION

The present application claims the benefit of patent application number 2006-061601, filed in Japan on Mar. 7, 2006, the subject matter of which is incorporated herein by reference.

BACKGROUND OF THE INVENTION

1. Field of the Invention

The present invention relates to a substrate polishing method for planarizing the surface of a substrate such as a semiconductor substrate and a liquid crystal substrate, and a method of manufacturing semiconductor device using the substrate polishing method.

2. Description of the Related Art

In a manufacturing process of semiconductor devices, chemical mechanical polishing (CMP) is widely used for planarizing an interlayer insulating film, forming a damascene interconnect structure, and forming a shallow trench isolation (STI).

FIG. 7 is a perspective view showing an example of a substrate polishing apparatus used for CMP (hereafter referred to as a CMP apparatus). As shown in FIG. 7, the CMP apparatus performs polishing by pressing a polishing surface of a substrate 3 to be polished held by a disk-shape carrier 1 onto a polishing cloth (polishing pad) 5 mounted on a disk-shape polishing platen 6 (hereafter referred to as a platen 6) at a specified pressure. At this time, the platen 6 is rotating in a specified direction centering a platen shaft 7 which supports the platen 6 at its center, and the carrier 1 is rotating in a specified direction centering a carrier shaft 8 which supports the carrier 1 at its center. The polishing pad 5 is made of closed-cell type polyurethane resin or non-woven fabric for example, and a polishing agent 11 (hereafter referred to as a slurry 11) having colloidal silica or fumed silica as its main ingredient is supplied onto the polishing pad 5 from a polishing agent supply unit 10. By this, the polishing surface of the substrate 3 is polished by the mechanical polishing effect due to friction with the polishing pad 5 and the chemical polishing effect by the slurry 11 so that the unevenness of the polishing surface of the substrate 3 is removed.

Ordinarily, the CMP apparatus has multiple carriers for improving the throughput of the polishing process. The CMP apparatus in FIG. 7 is provided with two pieces of carrier and can simultaneously polish the substrate 3 held by the carrier 1 and a substrate 4 held by the carrier 2 on one polishing pad 5 (hereafter called two-piece polishing).

FIG. 8 is a flow chart showing lot processing with a CMP apparatus which simultaneously polishes multiple pieces (two pieces in the example of FIG. 7) of substrates as one batch. Here, the lot is a process unit consisting of multiple pieces of substrates, and the number of substrates belonging to one lot is greater than the number of substrates processed in one batch.

As shown in FIG. 8, in lot processing, first the number of substrates processed in the same batch are selected from a substrate group constituting of a lot, and are polished with the CMP apparatus (S1→S2 in FIG. 8). When polishing is complete, if an unpolished substrate still remains in the same lot, polishing of the unpolished substrate is continued (S3 Yes in FIG. 8).

At this time, if the number of the unpolished substrates is equal to or greater than the number of substrates in one batch (two pieces here), in the same way as in the previous batch, the same number of substrates as the number of carriers are selected from unpolished substrates in the lot, and polishing is performed using all of the carriers (S4 Yes→S1→S2 in FIG. 8). However, if the number of the unpolished substrates is a fraction of the number of substrates in a batch, either of the following processing is conventionally performed (S4 No in FIG. 8).

The first method is a method wherein a piece of a dummy substrate is added to the lot to create an even number of pieces, and polishing is performed using all of the carriers under the same polishing conditions as that used in polishing the other batches (S5 Yes in FIG. 8).

The second method is a method wherein only the fractional number of substrates is mounted on the carrier, and polishing is performed only with some of the carriers (S5 No→S6 in FIG. 8). In this case, polishing cannot be performed under the same conditions as when polishing other batches, because there is a difference between the polishing rate of the substrate 3 when polishing is performed by mounting the substrate 3 only on the carrier 1 and the polishing rate of the substrate 3 when polishing is performed by mounting the substrates on the carrier 1 and the carrier 2, respectively in FIG. 7, for example. Also, the polishing rate is known to vary due to a polishing time, a polishing pressure when the carrier 1 presses the substrate onto the polishing pad 5, a relative velocity of polishing between the carrier 1 and the polishing pad 5, and a flow rate of the slurry 11, etc. Therefore, polishing is ordinarily performed by setting other conditions to be the same other than the polishing time and varying the polishing time only so that the same amount of polishing can be achieved.

When polishing is complete, if there is no unpolished substrate in the same lot, the lot processing ends (S3 No in FIG. 8).

The polishing time for the CMP polishing of an insulating film formed on a substrate from its initial film thickness to a target film thickness is obtained as follows. In CMP polishing, if the insulating film is formed on a substrate on which a pattern such as wiring is formed and unevenness exists, the polishing rate varies due to the density (sparse or dense) of the unevenness. Therefore, first the polishing time is obtained for a film formed on a substrate without unevenness (hereafter referred to as a flat film), and the polishing time for obtaining a desired amount of polishing can be calculated by using a polishing time multiplying a factor according to the density of unevenness to the polishing time for the flat film.

In general, in a CMP apparatus provided with n carriers, polishing time $T_n$ when polishing with a target polishing amount V is performed on n pieces of substrate in a batch can be calculated using polishing rates $R_1$~$R_n$ on 1st carrier ~nth carrier when polishing is performed by mounting a substrate having a flat film on each of 1st carrier ~nth carrier by Eq. (1) shown below.

$$T_n = f\left(V, \frac{\sum_{i}^{n} R_i}{n}\right) \tag{1}$$

Consequently, the polishing time $T_2$ when polishing with a target polishing amount V by the CMP apparatus in FIG. 7 which performs polishing of two pieces of substrate in one batch can be calculated using the polishing rate $R_1$ for a flat film on the substrate 3 held by the carrier 1 and polishing rate $R_2$ for a flat film on the substrate 4 held by the carrier 2 by Eq. (2) shown below.

$$T_2 = f\left(V, \frac{R_1 + R_2}{2}\right) \tag{2}$$

Therefore, in case that polishing is performed using all of the carriers, polishing for all substrates belonging to the same lot is performed based on the polishing time $T_2$ calculated from the above Eq. (2).

In case that polishing is performed for a fractional number of substrates using only some of the carriers, the polishing time is calculated (described in Japanese Unexamined Patent Application 2003-249467 for example) based on the polishing rate when polishing is performed in a state wherein a substrate having a flat film is mounted only on the carriers on which the fractional number of substrates are mounted (the carrier 1 in FIG. 7 for example).

SUMMARY OF THE INVENTION

However, in case that two pieces are polished as one batch, in the method to perform a lot processing by adding a dummy substrate when the number of substrates in a lot is odd, tasks is required wherein the dummy substrate is inserted to the lot before the CMP polishing process, and the dummy substrate is removed from the lot after the CMP polishing process. Because the dummy substrate is required to have an insulating film formed which can provide the same polishing rate as the substrate to be polished, a process is needed to manufacture dummy substrates which will not actually become products. Therefore, there has been the problem of increased manufacturing costs of semiconductor devices.

On the other hand, in the lot processing method wherein a fractional number of substrates are polished using only some of the carriers, when polishing conditions for which the polishing rate of a flat film in one-piece polishing under the same polishing conditions as in two-piece polishing has not been obtained, fraction number polishing cannot be performed. Therefore, if polishing conditions are changed, it is necessary to obtain the polishing rate of the flat film in one-piece polishing every time, or to obtain it in advance.

The present invention is been proposed considering the conventional situation, and its objective is to provide a substrate polishing method and a method of manufacturing semiconductor device which can make the amount of polishing for a fractional number of substrates to be the same amount of polishing as for other substrates polished using all of the carriers when performing CMP polishing of a lot consisting of a number of substrates which is not a multiple of the number of carriers with which in the CMP apparatus is provided.

In order to solve this problem, the present invention adopts the following technical means. First, the substrate polishing method of the present invention presumes a substrate polishing method used in a substrate polishing apparatus which has multiple carriers for one polishing pad and can simultaneously polish multiple substrates by pressing substrates held by the multiple carriers onto the polishing pad. Then, the substrate polishing method of the present invention calculates the polishing time necessary for obtaining a specific amount of polishing with substrate polishing using only a part of the carriers based on the polishing time necessary for polishing a specific amount of polishing in the substrate polishing using all of the carriers and a correction coefficient indicating the correlation between the polishing time for the substrate polishing using all of the multiple carriers and the polishing time for the substrate polishing using only a part of the multiple carriers. Based on calculated polishing time, substrates are polished using only a part of the carriers.

The correction coefficient may be set as a value according to the number of carriers used for polishing the substrates, and is set continuously or stepwise according to the accumulated amount of processing or accumulated number of processed pieces of substrates polished with the same polishing pad. If the polishing rate is such that the dependency of the correction coefficient on the accumulated amount polished can be suppressed, the correction coefficient may also be set to a fixed value.

According to the present invention, when a lot is processed with a substrate polishing apparatus having multiple carriers for one polishing pad, even if a substrate is polished using only some of the carriers, the same amount of polishing as for other substrates polished using all the carriers can be easily performed without adding a dummy substrate.

The foregoing and other objects, features, aspects and advantages of the present invention will become more apparent from the following detailed description of the present invention when taken in conjunction with the accompanying drawings.

DETAILED DESCRIPTION OF PREFERRED EMBODIMENTS

Figure 1:
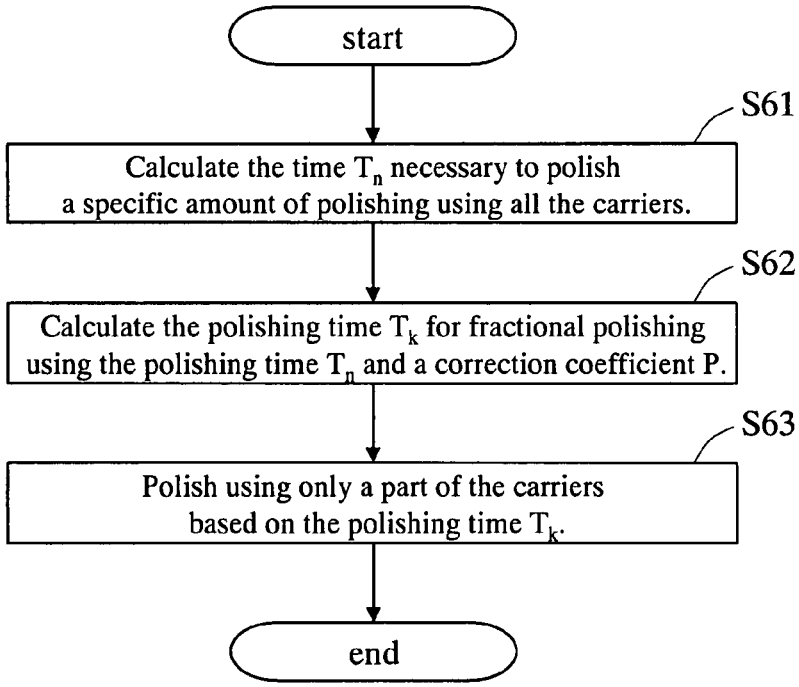
FIG. 1 is a flow chart showing the fractional number polishing that relates to an embodiment of the present invention.
Figure 8:
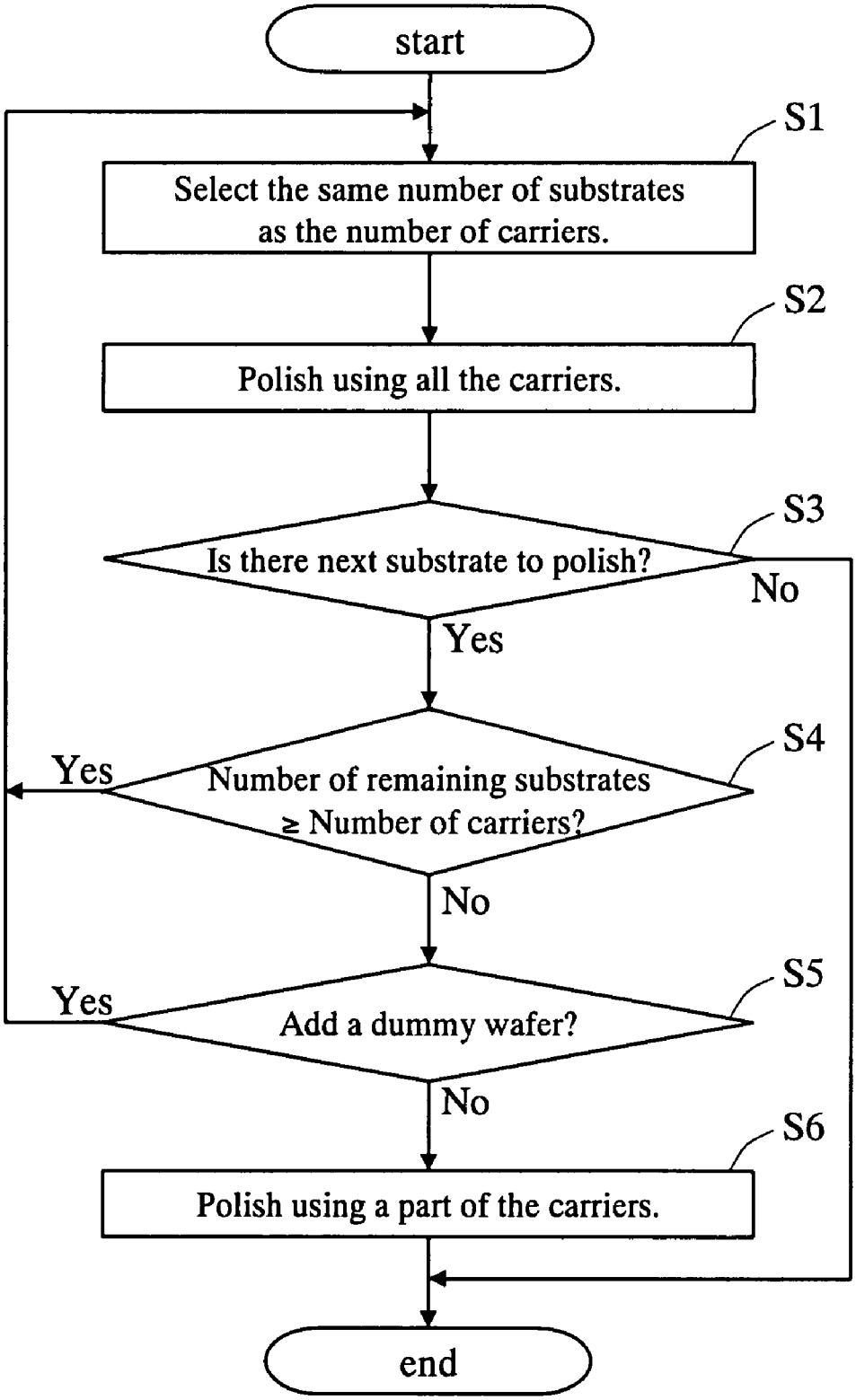
FIG.8 PRIOR ART
FIG. 8 is a flow chart showing a lot processing including a fractional number polishing in a polishing process.

The present invention is described in detail hereafter with reference to drawings. FIG. 1 is a flow chart showing the fractional number polishing in an embodiment of the present invention. Here, a flow chart in FIG. 1 corresponds to Step S6 in FIG. 8. A CMP apparatus to which the present invention is applied is the same as the conventional CMP apparatus in terms of its mechanical structure. Also, processes other than polishing a fractional number of substrates are the same as in the process where dummy substrate is not used on the flow chart shown in FIG. 8, so that the explanation is omitted.

In the substrate polishing method relating to the present invention, in a CMP apparatus provided with n carriers for one polishing pad, the polishing time $T_k$ for polishing k (k=1, 2, . . . , n−1) pieces of fractional number substrates occurring in the processing of polishing a lot consisting of a number of substrates which is not a multiple of the number of carriers using only k carriers is calculated based on Eq. (3) shown below.

$$T_k=f(T_n,P) \tag{3}$$

Here, the polishing time $T_n$ is the polishing time for obtaining a specific amount of polishing when polishing substrates using n carriers calculated by Eq. (1) above. Also, the coefficient P is a correction coefficient indicating the correlation between the polishing time in polishing using all (n) carriers and the polishing time in polishing using some (k) carriers for obtaining the same amount of polishing using all carriers.

Namely, in the substrate polishing method of the present invention, as shown in FIG. 1, first the polishing time $T_n$ for obtaining a specific amount of polishing in polishing using all carriers is calculated (S61 in FIG. 1). Next, the polishing time $T_k$ for polishing using only k carriers is calculated from a function of the polishing time $T_n$ and correction coefficient P (S62 in FIG. 1). By polishing a fractional number of substrates based on the thus calculated polishing time $T_k$, the same amount of polishing as the other substrates polished using all carriers can be obtained on the fractional number of substrates (S63 in FIG. 1).

Figure 7:
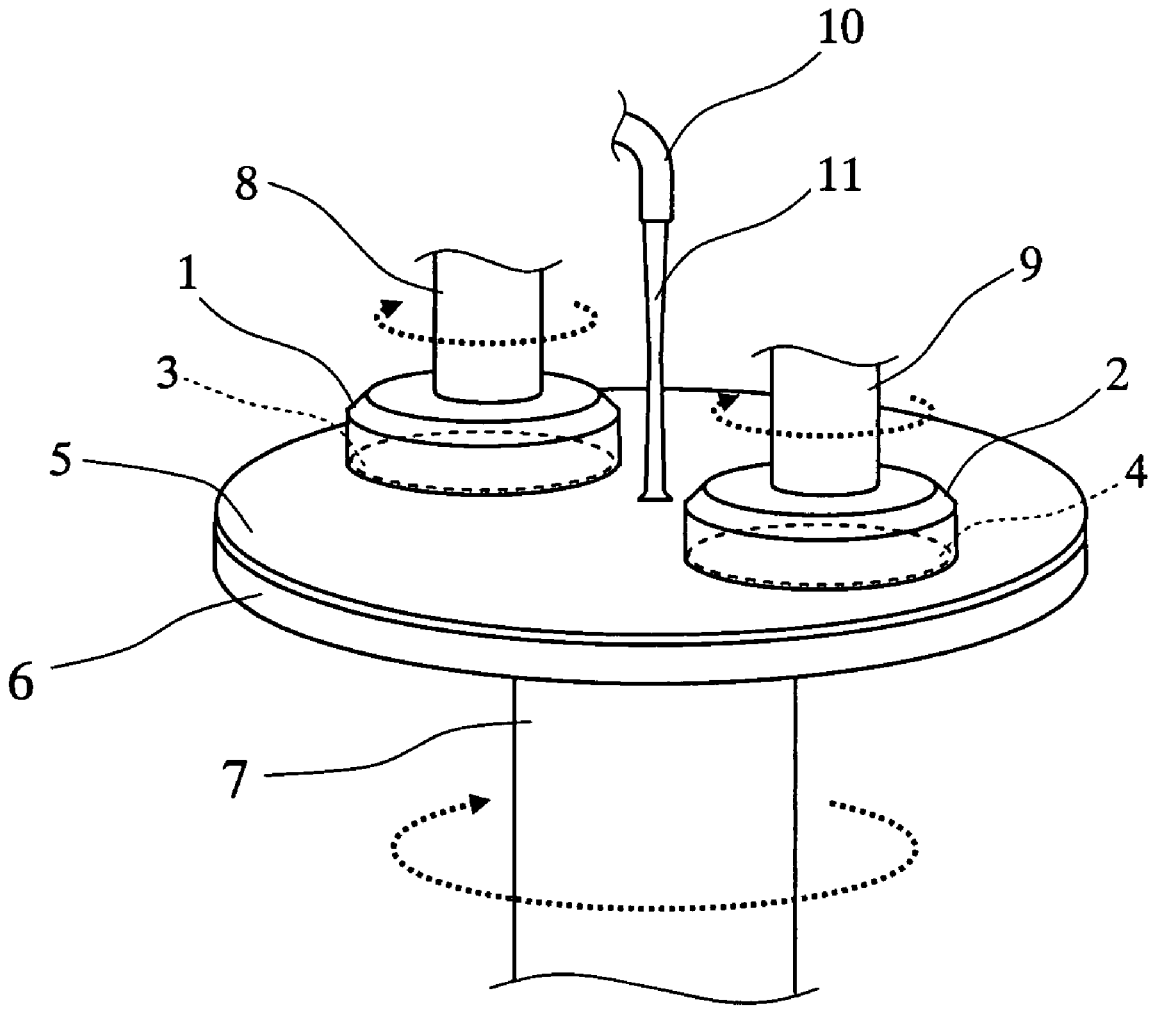
FIG.7 PRIOR ART
FIG. 7 is a perspective view of the CMP polishing apparatus.

For example, in the CMP apparatus shown in FIG. 7, polishing using all carriers is two-piece polishing, and polishing using some carriers becomes one-piece polishing. In this case, the polishing time $T_1$ for realizing the same amount of polishing by one-piece polishing as in the case of two-piece polishing over the polishing time $T_2$ is obtained from Eq. (4) shown below.

$$T_1=f(T_2,P) \tag{4}$$

First Embodiment

The substrate polishing method relating to the first embodiment of the present invention is described in detail hereafter, with reference to the drawings. First, in the substrate polishing method of this embodiment, Eq. (5) shown below is used as Eq. (4) above.

$$T_1=T_2\times P \tag{5}$$

Namely, the polishing time $T_1$ for polishing using only one carrier is calculated by multiplying a correction coefficient P to the polishing time $T_2$ which allows obtaining a specific amount of polishing in polishing using two carriers. The validity of calculating the polishing time for one-piece polishing by Eq. (5) above is explained below.

Figure 2:
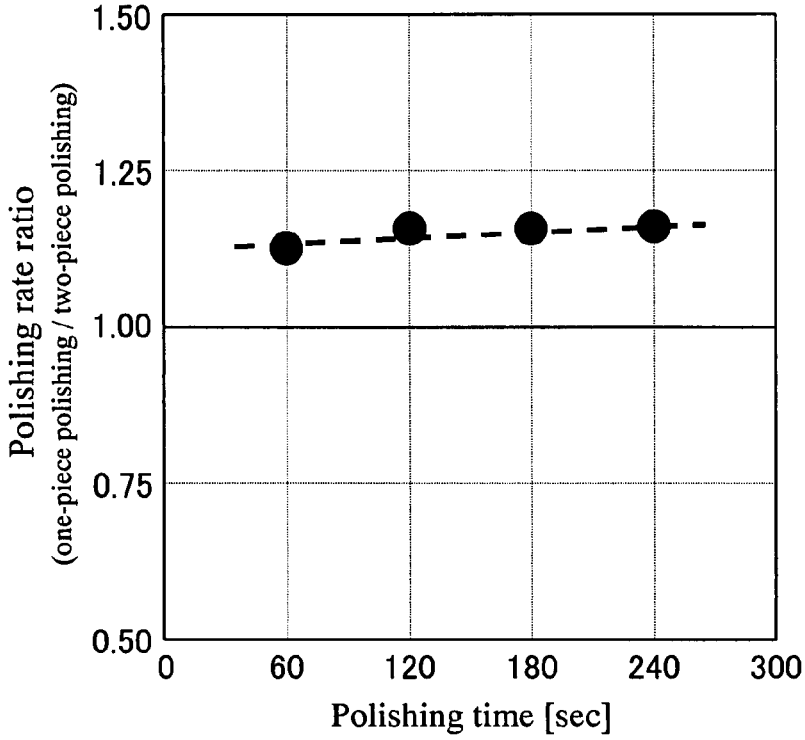
FIG. 2 is a plot showing the dependency of the polishing rate ratio on the polishing time that relates to an embodiment of the present invention.

FIG. 2 is a plot showing the polishing time dependency of the ratio of polishing rate in one-piece polishing and polishing rate in two-piece polishing (polishing rate in one-piece polishing/polishing rate in two-piece polishing, hereafter referred to as a polishing rate ratio) of a flat film made of P-TEOS (hereafter called P-TEOS flat film). Here, P-TEOS is a silicon oxide film formed by the plasma CVD (Chemical Vapor Deposition) from TEOS (Tetra Ethyl Ortho Silicate) as the raw material. In FIG. 2, the horizontal axis corresponds to the polishing time, and the vertical axis corresponds to the polishing rate ratio. Also, the polishing conditions of data plotted in FIG. 2 require that the polishing pressure to press the substrates onto the polishing pad be $45\times10^3$ N/m$^2$, the relative velocity of polishing between the carrier 1, 2 and the polishing pad 5 be 0.64 m/s, and that the supplying rate of the slurry 11 be 200 ml/min. Here, the relative velocity of polishing is the displacement per unit time of one point on the substrate on its track on the polishing pad as time passes. In this case, the point on the substrate is the center of the substrate.

As shown in FIG. 2, the polishing rate ratio is 1.13 when the polishing time is 60 seconds, and 1.16 when the polishing time is 240 seconds. It is understood that the rate of change of the polishing rate ratio when polishing time changed from 60 seconds to 240 seconds is about 2%, and that the polishing rate ratio becomes a constant value against polishing time. Therefore, the polishing time in one-piece polishing which yields the same amount of polishing as in two-piece polishing can be obtained using the same correction coefficient P regardless of the polishing time of two-piece polishing.

To the knowledge of the present inventors, under the polishing condition, the amount of polishing in two-piece polishing and the amount of polishing in one-piece polishing can be made the same by setting a value of 0.80~0.85 as the correction coefficient P. For example, when the correction coefficient P is 0.8, if polishing time $T_2$ in two-piece polishing is 150 seconds, the polishing time $T_1$ in one-piece polishing which yields the same amount of polishing as in the two-piece polishing becomes 120 seconds. The correction coefficient P becomes almost the same with the inverse of the polishing rate ratio.

Figure 3:
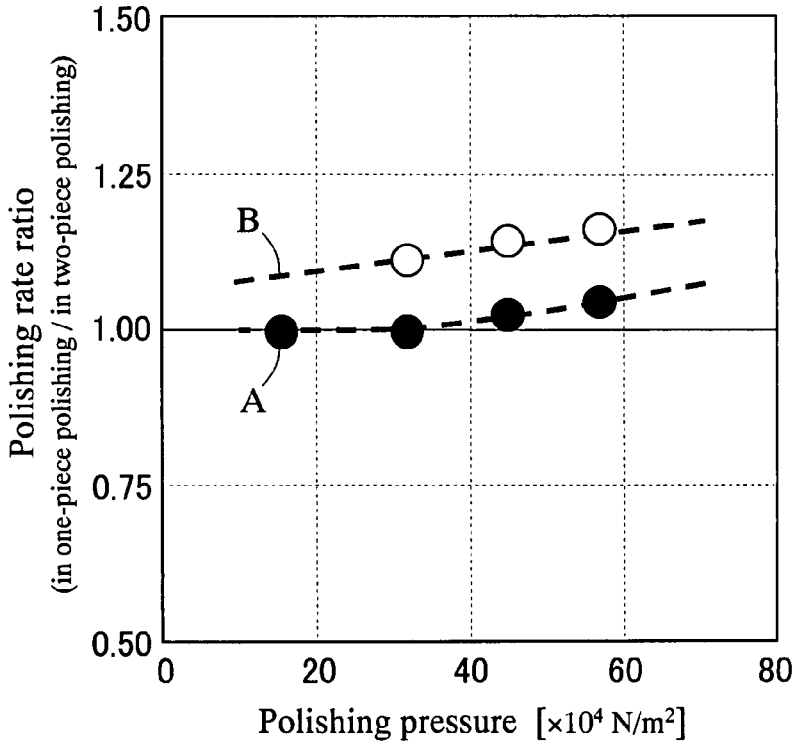
FIG. 3 is a plot showing the dependency of the polishing rate ratio on the polishing pressure that relates to an embodiment of the present invention.

On the other hand, FIG. 3 is a plot showing the polishing pressure dependency of the polishing rate ratio of a P-TEOS flat film. In FIG. 3, the horizontal axis corresponds to the polishing pressure, and the vertical axis corresponds to the polishing rate ratio. Also, in FIG. 3, the relative velocity of polishing varies as a parameter. The relative velocity of polishing of Data A shown in solid circles in FIG. 3 is 0.30 m/s, and the relative velocity of polishing of Data B shown in open circles is 0.64 m/s. Also, the supplying rate of the slurry 11 of data plotted in FIG. 3 is 200 ml/min. In either case, the polishing time is set to 180 seconds. However, because the polishing rate ratio does not depend on the polishing time as shown in FIG. 2, the same results would be also obtained as with other polishing times.

As shown in FIG. 3, if the relative velocity of polishing is 0.30 m/s, the polishing rate ratio is 1.00 when the polishing pressure is $30\times10^3$ N/m$^2$, and 1.04 when the polishing pressure is $60\times10^3$ N/m$^2$. Also, if the relative velocity of polishing is 0.64 m/s, the polishing rate ratio is 1.11 when polishing pressure is $30\times10^3$ N/m$^2$, and 1.16 when polishing pressure is $60\times10^3$ N/m$^2$.

Namely, the rate of change of the polishing rate ratio in the case that the polishing pressure changes from $30\times10^3$ N/m$^2$ to $60\times10^3$ N/m$^2$ is about 4% when the relative velocity of polishing is 0.30 m/s, and about 5% when the relative velocity of polishing is 0.64 m/s. While some variation occurs in the polishing rate ratio along with the polishing pressure, the rate of change is 5% or lower. Therefore, it is understood that the polishing rate ratio has no polishing pressure dependency, and that the same relative velocity of polishing yields a constant value for the polishing rate ratio.

The results indicate that there is no difference between the rate of change in the polishing rate in one-piece polishing and the rate of change in the polishing rate in two-piece polishing if only the polishing pressure varies. Therefore, the polishing time in one-piece polishing which yields the same amount of polishing as in two-piece polishing can be obtained using the same correction coefficient P regardless of the polishing pressure.

Figure 4:
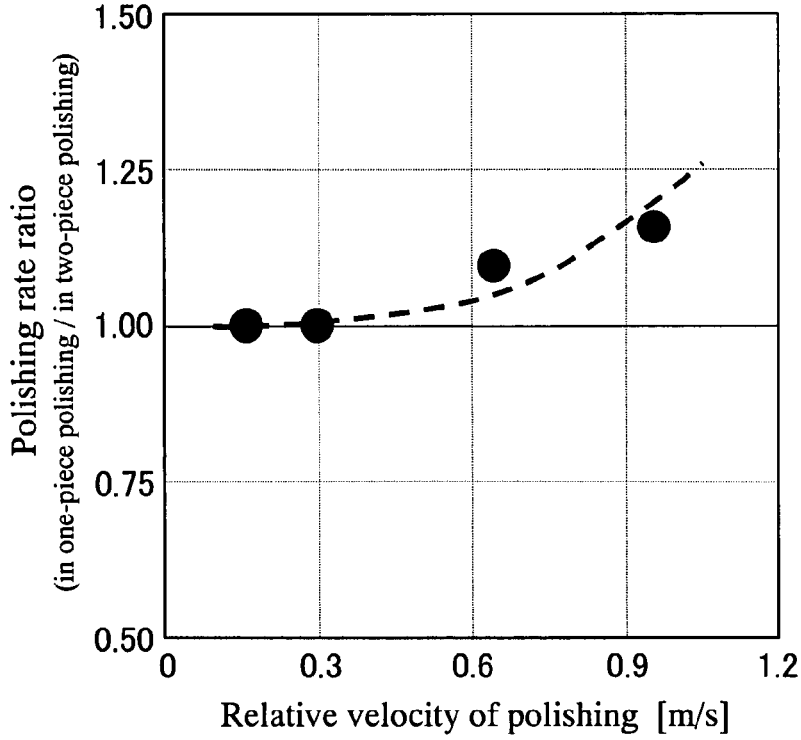
FIG. 4 is a plot showing the dependency of the polishing rate ratio on the relative velocity of polishing that relates to an embodiment of the present invention.

Furthermore, as can be easily speculated from FIG. 3, the polishing rate ratio is dependent on the relative velocity of polishing. FIG. 4 is a plot showing the dependency of the polishing rate ratio on the relative velocity of polishing of the P-TEOS flat film. In FIG. 4, the horizontal axis corresponds to the relative velocity of polishing, and the vertical axis corresponds to the polishing rate ratio. The polishing pressure of data plotted in FIG. 4 is $32\times10^3$ N/m$^2$ and the polishing time is 180 seconds. However, the polishing rate ratio does not depend on the polishing time and the polishing pressure as shown in FIG. 2 and FIG. 3. Therefore, the same results would be also obtained with other polishing times or other polishing pressures.

As shown in FIG. 4, the polishing rate ratio is 1.00 when the relative velocity of polishing is 0.30 m/s, and 1.16 when the relative velocity of polishing is 0.90 m/s. Namely, the rate of change of the polishing rate ratio in the case that the relative velocity of polishing changes from 0.30 m/s to 0.90 m/s is about 16%. Consequently, unlike the polishing time and the polishing pressure, the polishing rate ratio is dependent on the relative velocity of polishing. Also, it is understood from these results that the rate of increase in polishing rate along with the increase in relative velocity of polishing is larger in one-piece polishing than in two-piece polishing.

Figure 5:
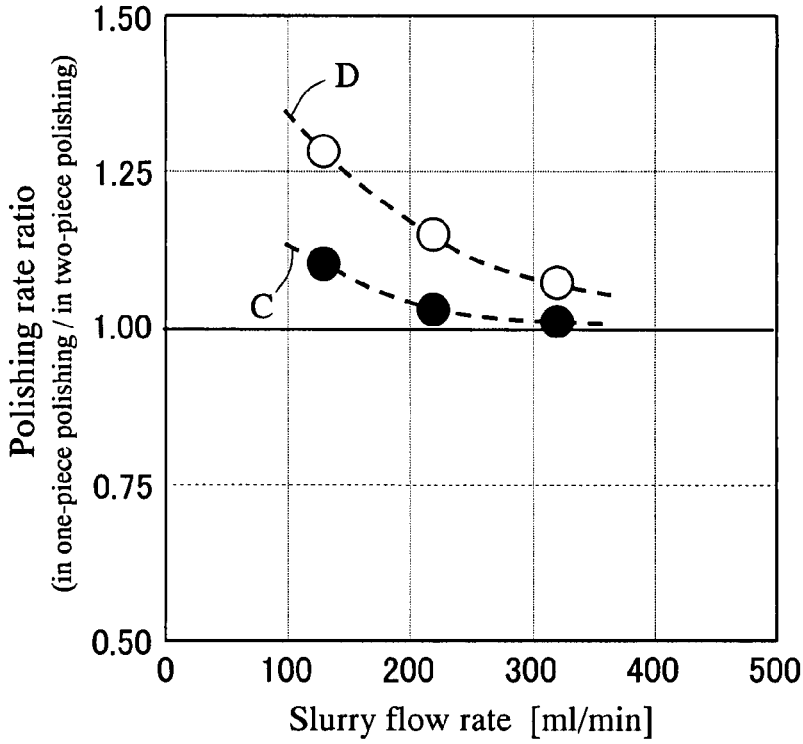
FIG. 5 is a plot showing the dependency of the polishing rate ratio on the slurry flow rate that relates to an embodiment of the present invention.

Also, FIG. 5 is a plot showing the dependency of the polishing rate ratio on the slurry flow rate of the P-TEOS flat film. In FIG. 5, the horizontal axis corresponds to the slurry flow rate, and the vertical axis corresponds to the polishing rate ratio. In addition, in FIG. 5, the relative velocity of polishing on which the polishing rate ratio is dependent varies as a parameter. In FIG. 5, the relative velocity of polishing of Data C shown in solid circles is 0.30 m/s, and the relative velocity of polishing of Data D shown in open circles is 0.64 m/s. The polishing pressure of data plotted in FIG. 5 is $45\times10^3$ N/m$^2$ and the polishing time is 180 seconds. However, the polishing rate ratio does not depend on the polishing time and the polishing pressure as shown in FIG. 2 and FIG. 3. Therefore, the same results would be also obtained with other polishing times or other polishing pressures.

In Data C in FIG. 5, the polishing rate ratio is 1.10 when the slurry flow rate is 130 ml/min, and 1.01 when the slurry flow rate is 320 ml/min. Also, in Data D, the polishing rate ratio is 1.28 when the slurry flow rate is 130 ml/min, and 1.07 when the slurry flow rate is 320 ml/min. Namely, the rate of change of the polishing rate ratio in the case that the slurry flow rate changes from 130 ml/min to 320 ml/min is about 10% when the relative velocity of polishing is 0.30 m/s, and about 20% when the relative velocity of polishing is 0.64 m/s.

Therefore, the polishing rate ratio is also dependent on the slurry flow rate in the same way as is the relative velocity of polishing. According to FIG. 5, it can be understood that the polishing rate ratio converges to 1.0 along with the increase in the slurry flow rate. These results indicate that the rate of increase in polishing rate along with the increase in the slurry flow rate is larger in two-piece polishing than in one-piece polishing, and that the difference between the polishing rate in one-piece polishing and the polishing rate in two-piece polishing becomes smaller along with the increase in the slurry flow rate.

Up to this point, dependencies of the polishing rate ratio on various kinds of polishing conditions have been described using FIGS. 2 to 5. Based on these results, the polishing rate ratio of one-piece polishing and two-piece polishing does not depend on the polishing time and the polishing pressure. Also, the polishing rate ratio in particular depends on the relative velocity of polishing and the slurry flow rate among polishing conditions. Namely, by fixing at least the relative velocity of polishing and the slurry flow rate to constant conditions, the polishing rate ratio of one-piece polishing and two-piece polishing becomes constant. Therefore, under such conditions, the same correction coefficient P can be used. Then, by performing one-piece polishing with the polishing time calculated by Eq. (5) using such correction coefficient P, the amount of polishing of the one-piece polishing can be made to be the same with the amount of polishing of other substrates polishing in two-piece polishing.

Moreover, as a result of analyzing the above results, the present inventors obtained the following knowledge. According to Preston's Law, the polishing rate R is proportional to the relative velocity of polishing and the polishing pressure. Here, employing slurry polishing contribution ratio κ defined by the present inventors, R is expressed as R=κ×(Relative velocity of polishing)×(Polishing pressure). The slurry polishing contribution ratio κ is the amount of slurry contributing to polishing substrates per unit area and is proportional to the number of slurry particles held on the polishing pad.

The number I of slurry particles held on the polishing pad can be expressed as I=G/H in terms of the number G of slurry particles supplied onto the polishing pad and the contact area H between the substrate and the polishing pad per unit time by employing a unsteady balance model. Here, the number G of slurry particles supplied onto the polishing pad is a monotonously increasing function proportional to the amount of slurry flow rate. And, the contact area H between the substrate and the polishing pad per unit time is a monotonously increasing function proportional to (Relative velocity of polishing)×(Substrate area). On the other hand, the number I of slurry particles held on the polishing pad cannot increase infinitely, but the upper limit dependent on the polishing pad exists.

Therefore, the larger the number G of slurry particles supplied onto the polishing pad is, and the smaller the contact area H between the substrate and the polishing pad per unit time is, the closer the number I of slurry particles held on the polishing pad converges to a specific upper limit value. Namely, the larger the slurry flow rate is, and the smaller the value of (Relative velocity of polishing)×(Substrate area) is, the closer the number of slurry particles held on the polishing pad converges to a specific upper limit value.

Through the above analysis, the present inventors found that under the same polishing conditions, because the substrate area is smaller in one-piece polishing than in two-piece polishing, the number I of slurry particles held on the polishing pad, namely the slurry polishing contribution ratio κ, becomes larger. Also, the present inventors found that the smaller the relative velocity of polishing is, or the larger the slurry flow rate is, the closer the number of slurry particles held on the polishing pad converges to the upper limit, reducing the difference in slurry polishing contribution ratio κ between one-piece polishing and two-piece polishing. Namely, the smaller the relative velocity of polishing is, or the larger the slurry flow rate is, the closer the polishing rate ratio converges to a specified value.

Therefore, under polishing conditions where the slurry polishing contribution ratio κ becomes equal between one-piece polishing and two-piece polishing, namely, in a region where relative velocity of polishing is relatively small (a finite value of 0.3 m/s or lower for example) or a region where the slurry flow rate is relatively large (a finite value of 400 ml/min or higher for example), even when the relative velocity of polishing and the slurry flow rate are changed, the polishing rate ratio can be regarded as constant.

Therefore, in regions of the relative velocity of polishing and the slurry flow rate mentioned above, the correction coefficient P can be set to a fixed value. Also, the amount of polishing in one-piece polishing can be made the same as the amount of other substrates polished in two-piece polishing by polishing with the polishing time obtained by Eq. (5) using the correction coefficient P. Moreover, when there is unevenness on the substrate surface, the polishing time for achieving a desired amount of polishing can be obtained by multiplying a coefficient according to the density of the unevenness to the polishing time obtained by Eq. (5) upon necessity.

A CMP apparatus having two carriers 1 and 2 for one polishing pad 5 has been described above. However, the above-mentioned content can be applied to a CMP apparatus provided with n carriers for one polishing pad. When polishing a lot consisting of a number of substrates which is not an integer multiple of n by such CMP apparatus, the lot processing would generate a batch wherein a number of substrates (1~n−1 pieces) which are fewer than n pieces are polished.

Based on the slurry polishing contribution ratio described above, the slurry polishing contribution ratio varies according to the number of substrates polished simultaneously. Therefore, the polishing time when polishing substrates using only some of carriers also needs to be set in (n−1) variations according to the number of substrates polished simultaneously.

Here, the polishing time for obtaining a specific amount of polishing when polishing a P-TEOS flat film using all (n) carriers is denoted as $T_n$. Also, the correction coefficient indicating the correlation between the polishing time for polishing substrate using all (n) carriers and the polishing time for polishing substrate using some (k) of carriers for obtaining the same amount of polishing as in polishing using all carriers is denoted as $P_{nk}$. In this case, the polishing time $T_{nk}$ can be expressed by the following Eq. (6) in the same manner with the Eq. (5).

$$T_{nk}=T_n\times P_{nk} \tag{6}$$

Needless to say, the polishing time $T_n$ is obtained from Eq. (1). The correctional coefficient $P_{nk}$ can be expressed by the following Eq. (7) in terms of the polishing rate $R_n$ for polishing the P-TEOS flat film using n carriers and the polishing rate $R_k$ for polishing the P-TEOS flat film using only k carriers.

$$P_{nk}=R_n/R_k \tag{7}$$

Therefore, as shown in FIG. 4 and FIG. 5, the polishing time $T_{nk}$ (k=1~n−1) can be calculated by pre-calculating the correction coefficient $P_{nk}$ (k=1~n−1) according to the relative velocity of polishing and the slurry flow rate. Then, by polishing a fractional number of substrates with the polishing time $T_{nk}$, the amount of polishing when polishing them using k carriers can be made to be the same with the amount of polishing of other substrates polished using all (n) carriers. If there is unevenness on the substrate surface, the polishing time for obtaining a desired amount of polishing can be obtained by multiplying a coefficient according to the unevenness to the polishing time calculated by the Eq. (6)

Second Embodiment

In general, in the CMP polishing, the polishing rate decreases along with the increase of the accumulated number of processed substrates (accumulated amount of polishing) polished with the same polishing pad 5. This phenomenon occurs caused by the clogging of the polishing pad due to polish wastes of the polishing pad and substrate, and the decrease in groove depth of the polishing pad accompanying the dressing of the polishing pad 5. In this embodiment, the dependency of the polishing rate ratio on the accumulated number of processed substrates is explained.

Figure 6:
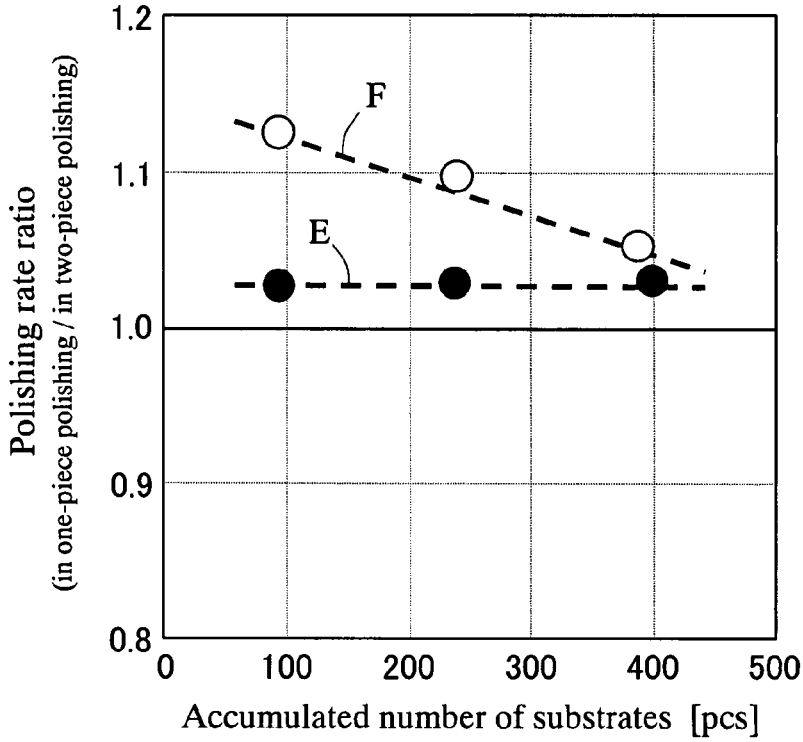
FIG. 6 is a plot showing the dependency of the polishing rate ratio on the accumulated number of substrates that relates to an embodiment of the present invention.

FIG. 6 is a plot showing the dependency of the polishing rate ratio of the P-TEOS flat film on the accumulated number of processed substrates (hereafter referred to as an accumulated number of substrates). In FIG. 6, the horizontal axis corresponds to the accumulated number of substrates, and the vertical axis corresponds to the polishing rate ratio. In FIG. 6, data in two kinds of polishing conditions are shown. The polishing conditions of Data E plotted in solid circles in FIG. 6 require that the polishing pressure be $45\times10^3$ N/m$^2$, the relative velocity of polishing be 0.30 m/s, and that the slurry flow rate be 200 ml/min. Also, the polishing conditions of Data F plotted in open circles in FIG. 6 require that the polishing pressure be $45\times10^3$ N/m$^2$, the relative velocity of polishing be 0.64 m/s, and that the slurry flow rate be 200 ml/min. While the polishing time is set to 180 seconds under both conditions, the polishing rate ratio does not depend on the polishing time as shown in FIG. 2. Also, in FIG. 6, the polishing rate ratio for the accumulated number of substrates of 100 pieces indicates the polishing rate ratio measured after polishing 100 pieces of substrates.

In Data E plotted in FIG. 6, there is no difference between the polishing rate ratio when the accumulated number of substrates is 100 pieces and the polishing rate ratio when the accumulated number of substrates is 400 pieces. On the other hand, in Data F, the polishing rate ratio is 1.13 when the accumulated number of substrates is 100 pieces, and 1.04 when the accumulated number of substrates is 400 pieces. Namely, the rate of change in the polishing rate ratio in the case that the accumulated number of substrates changes from 100 pieces to 400 pieces is about 0% when the relative velocity of polishing is 0.30 m/s, and about 10% when the relative velocity of polishing is 0.64 m/s.

FIG. 6 shows that there may be cases where the polishing rate ratio depends on the accumulated number of substrates, and that when the relative velocity of polishing is 0.64 m/s for example, if a correction coefficient P which yields the same amount of polishing between one-piece polishing and two-piece polishing when the accumulated number of substrates is small, there is an error of about 10% in the amount of polishing when 400 pieces of substrates are subsequently polished. Namely, when the relative velocity of polishing is 0.64 m/s, if the correction coefficient P is set to a fixed value, the amount of polishing of a fractional number of substrates does not become the same with the amount of polishing of other substrate polishing using all carriers.

As a countermeasure, this embodiment adopts a construction wherein the correction coefficient varies along with an increase in the accumulated number of substrates. As shown in Data F plotted in FIG. 6, the polishing rate ratio decreases monotonously as the accumulated number of substrates increases, indicating that the rate of decrease in the polishing rate along with the increase in the accumulated number of substrates is larger in one-piece polishing than in two-piece polishing. Also, according to discussions based on the above principle that the polishing rate decreases, the rate of decrease in the polishing rate decreases as the accumulated number of substrates increases, and the polishing rate ratio converges to a constant value.

Therefore, the polishing error accompanying the increase in the accumulated number of substrates described above can be reduced by varying the correction coefficient P according to the accumulated number of substrates utilizing above characteristic. To the knowledge of the present inventors, the amount of polishing in one-piece polishing can be made to be the same with the amount of polishing of other substrates polished in two-piece polishing by polishing them with the polishing time calculated by Eq. (5) using the correction coefficient P after increasing the correction coefficient P by 0.05 per 200 pieces of accumulated number of substrates. The method of varying the correction coefficient P according to the accumulated number of substrates may be applied according to the number of polished substrates, either by changing stepwise the correction coefficient P every time polishing one batch of substrates has been finished or by changing stepwise the correction coefficient P every time multiple batches of substrates have been polished, such as, for example, by increasing the correction coefficient P by 0.01 every time 40 pieces of substrates have been polished. Furthermore, the correction coefficient P may be continuously varied in real-time according to the accumulated amount of polishing (or the corresponding polishing time).

On the other hand, according to Data E shown in FIG. 6, there is also a polishing condition under which the polishing rate ratio shows a constant value regardless of the accumulated number of substrates. It is also possible to suppress the variation of the polishing rate ratio due to the accumulated number of substrates by actively utilizing such polishing condition. And polishing errors accompanying the increase in the accumulated number of substrates such as the above can be reduced by utilizing a polishing condition which can suppress the variation of the polishing rate ratio and making the correction coefficient P a fixed value instead of varying the correction coefficient P according to the accumulated number of substrates.

This polishing condition has, in comparison with the polishing condition of Data F, small polishing pressure and relative velocity of polishing. However, as shown in FIG. 3, the polishing rate ratio can be regarded as constant against variations of polishing pressure. Therefore, by reducing the relative velocity of polishing, variation in the polishing rate ratio due to the accumulated number of substrates can be suppressed.

However, under conditions in which the relative velocity of polishing is relatively small, because the polishing rate decreases, there is concern that throughput of the polishing process may decrease. This decrease in the polishing rate can be dealt with by increasing the polishing pressure. If the polishing pressure is increased, the polishing rate increases proportionally according to so-called Preston's Law. Moreover, as shown in FIG. 3, when the polishing pressure is increased, the polishing rate ratio has little change. Therefore, by increasing polishing pressure, variation of the polishing rate ratio due to the accumulated number of substrates can be suppressed without decreasing the throughput of the polishing process.

As described above, according to this embodiment, whichever method is adopted, regardless of the accumulated number of substrates, the amount of polishing in one-piece polishing can be made to be the same with the amount of polishing of other substrates by polishing in two-piece polishing with the polishing time calculated by Eq. (5) using the correction coefficient P. Needless say, the method explained in this embodiment can also be applied to $P_{nk}$ shown in Eq. (6).

The present invention is not limited to the embodiments explained above, but various kinds of modifications and applications are possible within a range in which the present invention is effective. Namely, while the polishing rate was obtained using a P-TEOS flat film in the above, the polishing rate may be calculated by Eq. (1) with a flat film made of the same material as the polishing target material film or a substrate with no unevenness made of the same material as the polishing target substrate. Also, it is not crucial to calculate the polishing time $T_n$ by Eq. (1), but the actual time of polishing a substrate having unevenness on the surface to a desired film thickness may be set to the polishing time $T_n$. In this case, there is no need to multiply a coefficient according to the unevenness of the substrate surface to the polishing time $T_k$ calculated by Eq. (6).

Also, the substrate polishing method explained above can be realized, for example, by a conventional substrate polishing apparatus provided with multiple carriers for one polishing pad being further equipped with, in polishing substrates using all the carriers, a means for calculating the polishing time $T_n$ (or a means for storing the input polishing time $T_n$) necessary to obtain a specific amount of polishing, and a means for calculating the polishing time $T_k$ necessary to obtain the specific amount of polishing in polishing substrates using only a part of the carriers based on the calculated (or stored) polishing time and the correction coefficient described above. In this substrate polishing apparatus, a desired amount of polishing can be easily realized by polishing substrates for the calculated polishing time $T_k$ using only a part of the carriers. The means of performing each of the calculations can be realized, for example, as a dedicated arithmetic circuit, hardware equipped with a processor and memory such as RAM and ROM, and software which is stored in the memory and operates on the processor.

Furthermore, by using the substrate polishing method explained above, it becomes possible to manufacture semiconductor devices wherein variations in properties are small within each lot.

The present invention makes it possible, in a substrate polishing apparatus having multiple carriers for one polishing pad, to easily set a polishing time corresponding to the number of used carriers so as to yield the same amount of polishing as in polishing substrates using all the carriers based on the polishing time for the substrate polishing, and is useful as a substrate polishing method.

While the invention has been shown and described in detail, the foregoing description is in all aspects illustrative and not restrictive. It is therefore understood that numerous modifications and variations can be devised without departing from the scope of the invention.

The invention claimed is:

1. A substrate polishing method used in a substrate polishing apparatus which has multiple carriers for one polishing pad and which can simultaneously polish multiple substrates by pressing substrates held by the multiple carriers onto the polishing pad, comprising the steps of:

obtaining a polishing time necessary for a specific amount of polishing in polishing substrates using all the carriers;

calculating a polishing time necessary for the specific amount of polishing in polishing substrates using only a part of the carriers based on the obtained polishing time and a correction coefficient indicating the correlation between a polishing time in polishing substrates using all the carriers and a polishing time in polishing substrates using only a part of the carriers; and polishing substrates using only a part of the carriers according to the calculated polishing time.

2. A substrate polishing method according to claim 1, wherein the correction coefficient is a value corresponding to the number of carriers used for polishing substrates.

3. A substrate polishing method according to claim 2, wherein the correction coefficient is a value corresponding to the accumulated amount of polishing of polished substrates on the same polishing pad.

4. A substrate polishing method according to claim 2, wherein the correction coefficient is a value set stepwise corresponding to the accumulated amount of polishing of substrates.

5. A substrate polishing method according to claim 2, wherein a relative velocity of polishing between the polishing pad and the carriers is set to a velocity by which the dependency of the correction coefficient on the accumulated amount of polishing is suppressed, and the correction coefficient is given a fixed value.

6. A substrate polishing method according to claim 1, wherein the correction coefficient is a value corresponding to the accumulated amount of polishing of polished substrates on the same polishing pad.

7. A substrate polishing method according to claim 1, wherein the correction coefficient is a value set stepwise corresponding to the accumulated amount of polishing of substrates.

8. A substrate polishing method according to claim 1, wherein a relative velocity of polishing between the polishing pad and the carriers is set to a velocity by which the dependency of the correction coefficient on the accumulated amount of polishing is suppressed, and the correction coefficient is given a fixed value.

9. A semiconductor device manufacturing method including a process in which planarization of substrate surface is performed by a substrate polishing apparatus which has multiple carriers for one polishing pad and which can simultaneously polish multiple substrates by pressing substrates held by the multiple carriers onto the polishing pad, comprising the steps of:

obtaining a polishing time necessary for a specific amount of polishing in polishing substrates using all the carriers;

calculating a polishing time necessary for the specific amount of polishing in polishing substrates using only a part of the carriers based on the obtained polishing time and a correction coefficient indicating the correlation between a polishing time in polishing substrates using all the carriers and a polishing time in polishing substrates using only a part of the carriers; and polishing substrates using only a part of the carriers according to the calculated polishing time.

10. A semiconductor device manufacturing method according to claim 9, wherein the correction coefficient is a value corresponding to the number of carriers used for polishing substrates.

11. A semiconductor device manufacturing method according to claim 10, wherein the correction coefficient is a value corresponding to the accumulated amount of polishing of polished substrates on the same polishing pad.

12. A semiconductor device manufacturing method according to claim 10, wherein the correction coefficient is a value set stepwise corresponding to the accumulated amount of polishing of substrates.

13. A semiconductor device manufacturing method according to claim 10, wherein a relative velocity of polishing between the polishing pad and the carriers is set to a velocity by which the dependency of the correction coefficient on the accumulated amount of polishing is suppressed, and the correction coefficient is given a fixed value.

14. A semiconductor device manufacturing method according to claim 9, wherein the correction coefficient is a value corresponding to the accumulated amount of polishing of polished substrates on the same polishing pad.

15. A semiconductor device manufacturing method according to claim 9, wherein the correction coefficient is a value set stepwise corresponding to the accumulated amount of polishing of substrates.

16. A semiconductor device manufacturing method according to claim 9, wherein a relative velocity of polishing between the polishing pad and the carriers is set to a velocity by which the dependency of the correction coefficient on the accumulated amount of polishing is suppressed, and the correction coefficient is given a fixed value.

* * * * *